US007221100B2

(12) United States Patent
Baksht et al.

(10) Patent No.: US 7,221,100 B2
(45) Date of Patent: May 22, 2007

(54) GAS DISCHARGE LAMP POWER SUPPLY

(75) Inventors: Evgeny H. Baksht, Tomsk (RU); Mikhail I. Lomaev, Tomsk (RU); Dmitry V. Rybka, Tomsk (RU); Victor F. Tarasenko, Tomsk (RU); Mahadevan Krishnan, Oakland, CA (US); John R. Thompson, San Diego, CA (US)

(73) Assignee: Alameda Applied Sciences Corp., San Leandro, CA (US)

( * ) Notice: Subject to any disclaimer, the term of this patent is extended or adjusted under 35 U.S.C. 154(b) by 96 days.

(21) Appl. No.: 11/203,599

(22) Filed: Aug. 12, 2005

(65) Prior Publication Data

US 2007/0035256 A1 Feb. 15, 2007

(51) Int. Cl.
*H05B 37/02* (2006.01)

(52) U.S. Cl. ..... 315/209 R; 315/243; 315/241 R; 315/241 P

(58) Field of Classification Search ..... 315/209 R, 315/209 CD, 224, 241 R, 241 S, 240, 241 P, 315/242, 243, 227 R
See application file for complete search history.

(56) References Cited

U.S. PATENT DOCUMENTS 4,005,336 A * 1/1977 Casella ..... 315/239
4,194,143 A * 3/1980 Farkas et al. ..... 315/241 R
4,524,289 A * 6/1985 Hammond et al. ..... 307/110
5,587,629 A * 12/1996 Gornstein ..... 315/200 R
5,777,867 A * 7/1998 Hongu et al. ..... 363/134
6,323,600 B1 * 11/2001 Statnic et al. ..... 315/209 R
6,888,319 B2 * 5/2005 Inochkin et al. ..... 315/243

* cited by examiner

*Primary Examiner*—Tuyet Vo
*Assistant Examiner*—Ephrem Alemu
(74) *Attorney, Agent, or Firm*—Jay A. Chesavage; File-EE-Patents.com

(57) ABSTRACT

An apparatus for providing power to a gas discharge lamp comprises a storage capacitor and an ignition switch coupled through a primarily parasitic first inductor to a parallel combination of a diode assembly and a second inductor in series with a gas discharge lamp. The second inductor is selected to optimize the energy transfer from the capacitor to the gas discharge lamp. During a first interval determined by the time constant of the series combination of a storage capacitor, a first inductor, and a second inductor, the diode assembly is not conducting and a forward sense current builds in the first and second inductors. During a second interval determined by the interaction of the two parallel circuits driving the gas discharge lamp, during which the diode array is conducting, the smaller reversed sense current flowing in the first inductor and a larger forward sense current flowing in the second inductor add, thereby generating a unipolar, forward sense, single pulse current output for the generation of optical energy by a gas discharge lamp.

24 Claims, 3 Drawing Sheets

$$T_0 \simeq 2\pi\sqrt{(L1+L2)C}$$
$$T_1 \simeq 2\pi\sqrt{(L1)C}$$

GAS DISCHARGE LAMP POWER SUPPLY

FIELD OF THE INVENTION

The present invention relates to the class of power supplies used to deliver a shaped current pulse to a gas discharge lamp or tube for the generation of a maximum intensity, single pulse, optical output.

BACKGROUND OF THE INVENTION

FIG. 1*a* shows a prior art gas discharge power supply 10 including a capacitor 12 which is charged by voltage source 15 in series with current limiting resistor 16. When the voltage level of capacitor 12 reaches a desired level, an ignition 14 is triggered, which acts as a switch device delivering charge from the storage capacitor 12 to a series combination of lead inductance 18, and a lamp assembly 21 which is electrically modeled as a gas discharge lamp 22, which acts as a constant voltage drop, in series with an arc resistance 20, which has a current-dependant voltage drop. Typically, the arc resistance 20 is very small compared to either the inductive impedance of lead inductance 18 or the capacitive reactance of storage capacitor 12, thereby producing an under-damped series RLC circuit. FIG. 2 shows the waveforms of operation of FIG. 1*a*. At a time t=0 us, ignition 14 is triggered and operates as a closed circuit, resulting in the transfer of energy from storage capacitor 12 to the series circuit of lamp assembly 21 including resistance 20, and lead inductance 18. The current which results from the ignition 14 switch closing is an oscillatory LRC decay I1 32 shown in FIG. 2, where frequency and decay are determined by L R and C according to the well-known formula:

$$I(t) = I_{\max} e^{\frac{-R}{2L}t} \sin\left(\sqrt{\frac{1}{LC} - \left(\frac{R}{2L}\right)^2}\, t\right)$$

When R=0.01 ohms, C=0.5 uF and L=50 nH in FIG. 1*a*, the current waveform I1 32 is oscillatory as shown in FIG. 2, and lamp 22 generates multiple bursts of optical energy 28, shown as waveform E1 30. Each burst of optical energy 28 is approximately 1 μs in duration, and multiple bursts are emitted until the oscillatory voltage which appears across the gas discharge lamp 22 falls to below the actuation level of the lamp 22. This results in a plurality of optical bursts at the rate of oscillatory decay, with each subsequent optical pulse of reduced magnitude compared to the previous burst.

In applications where the lamp 22 is generating an optical burst 28 for use as control energy for an UV/optical switch such as a diamond switch, or some other photo-conducting device using UV/optical control, and the optical energy level is often required to be large in magnitude and short in duration, a problem arises whereby the size of the capacitor C 12 (due to limits on the applied voltage V 15) becomes too large to support the burst energy requirement. This increased capacitance 12 causes the resonant frequency to be reduced, which increases the time duration and reduces the rise time of the optical control signal produced by the gas discharge lamp 22.

It is desired to reduce the duration of the oscillatory decay, and further to capture the energy associated with the oscillatory decay and redirect it to the optical lamp, thereby producing a single, uni-polar pulse of current, which translates into a single burst or pulse of emitted optical energy 28.

An alternative embodiment 21 of prior art FIG. 1*a*, shown in FIG. 1*b*, places a second closing switch 15 directly in parallel with both the capacitor 12 and switch 14, and the flash lamp assembly 21. The first switch 14 is closed at an initial time t1, followed at time t2 by second closing switch 15, where the first switch 14 closing time and second switch 15 closing time is controlled by controller 17, and the second switch 15 is triggered to close at the time of the first quarter period following the first switch 14 closure. This method also has the disadvantage that for some circuit parameters, the current through the gas discharge lamp can reverse direction, thereby allowing the current to pass through zero and allowing the lamp discharge gas to begin cooling, which results in reduced optical emission from the lamp.

U.S. Pat. No. 3,465,203 by Galster et al describes a circuit for discharging stored charge into a flashlamp using inductors, capacitors, and diodes. Resonant current from the inductor/capacitor combination is redirected through clamping diodes to extend the capacitor discharge time.

U.S. Pat. No. 4,194,143 by Farkas et al describes the use of a resonant LC circuit to generate multiple flash lamp discharges.

U.S. Pat. No. 4,524,289 by Hammond et al describes a flash lamp using inductors, capacitors, and switches to transfer current from two resonant LC circuits to a flash lamp load.

A flash lamp control circuit is desired which generates a single pulse of current which can be optimized for power output and minimized for time duration.

OBJECTS OF THE INVENTION

A first object of the invention is a power source for a gas discharge lamp which generates an optimized pulse of current for use by the gas discharge lamp.

A second object of the invention is a power source for a gas discharge lamp which allows redirection of the majority of the energy stored in a secondary inductor, to the gas discharge lamp, through a circuit bypassing the initial energy storage capacitor, thereby maintaining a unipolar current drive to the gas discharge lamp.

SUMMARY OF THE INVENTION

A power supply 40 for a gas discharge lamp comprises a switch 44, an energy storage capacitor 42, a first inductor 54, primarily associated with the parasitic inductance of the switch 44, capacitor 42, and their connections to the remaining circuit, a diode assembly 49 having a series inductance Ld 60 and resistance Rd 47, where the diode assembly 49 is also in parallel with the series combination of a gas discharge lamp 51 and a secondary, inductor L2 58, which includes the inductance associated with the gas discharge lamp 52. The secondary inductor 58 is chosen for a level of inductance such that at peak current the energy inductively associated with the secondary inductor 58 is preferably much larger than that of the first inductor 54, and such that the sum of the first inductor 54 and second inductor 58, when combined with the capacitance of the initial storage capacitor 42, results in an initial oscillatory period on the order of the time scale desired for the optical pulse width. Following the first quarter period of this oscillatory period, and then subsequently following with each further same-sense reversal of the time-derivative of the current I2 ($dI_2/dt$) through the secondary inductor 58, the polarity of the reactive L2*$dI_2/dt$ voltage drop across the secondary inductor 58 reverses. Each time this same-sense polarity reversal occurs and as the L2 times $dI_2/dt$ voltage exceeds that of the voltage drop across the gas discharge lamp, V3, which has a voltage drop of the opposite polarity sense at that time, the polarity of the net voltage drop across the combined secondary inductor and gas discharge lamp puts the diode 53 in forward bias, allowing a substantial portion of the current I2 flowing through the secondary inductor 58 to be redirected to the gas discharge lamp 52 through the diode 53, a circuit independent of the initial storage capacitor C0 and inductor L1, thereby changing the discharge circuit associated with inductor L2 58 to include the diode 49, inductor 58, and flashlamp 52, and resulting in a continuous unipolar flow of current through the flashlamp, thereby increasing the peak output of the initial optical burst from the lamp and reducing the number of cycles of lamp reignition.

DETAILED DESCRIPTION OF THE INVENTION

Figure 1A:
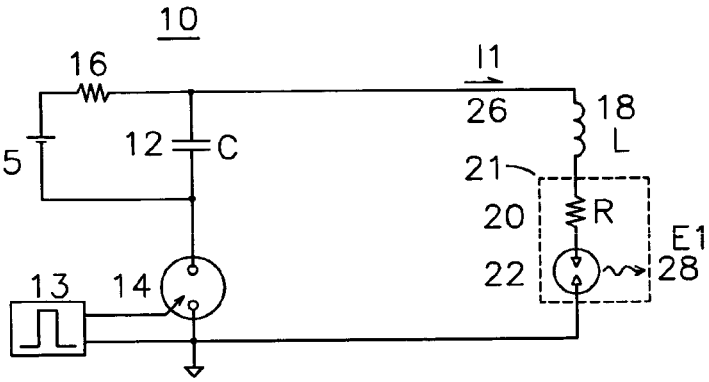
Figure 1a Prior Art
FIG. 1*a* shows a schematic diagram for a prior art power source for a gas discharge tube.
Figure 1B:
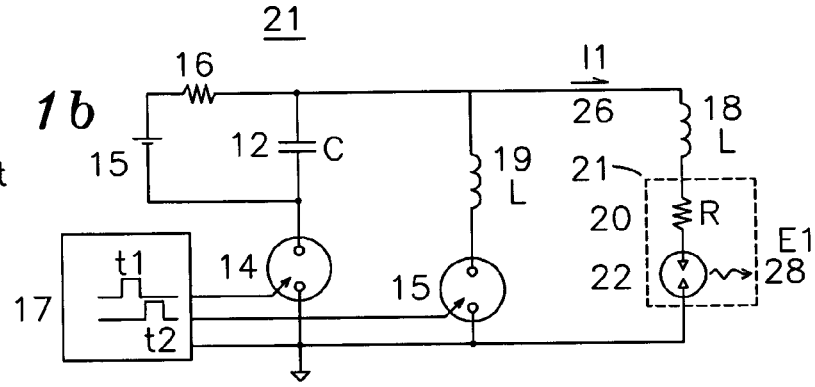
Figure 1b Prior Art
FIG. 1*b* shows a schematic diagram for an alternate prior art power source for a gas discharge tube.
Figure 2:
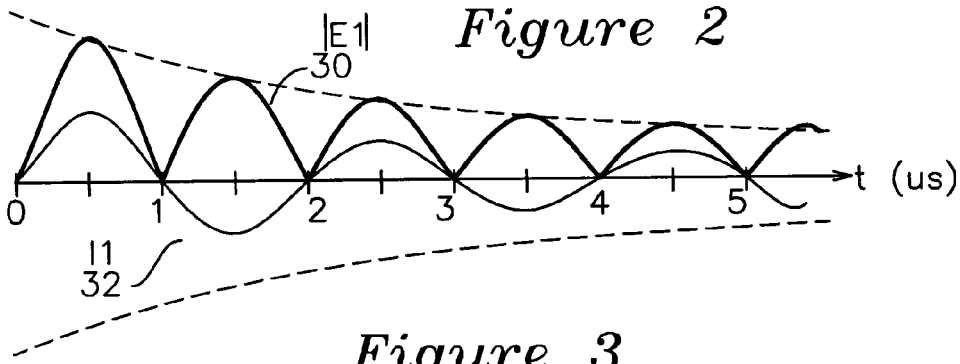
FIG. 2 shows the waveforms of operation for FIG. 1*a*.
Figure 3:
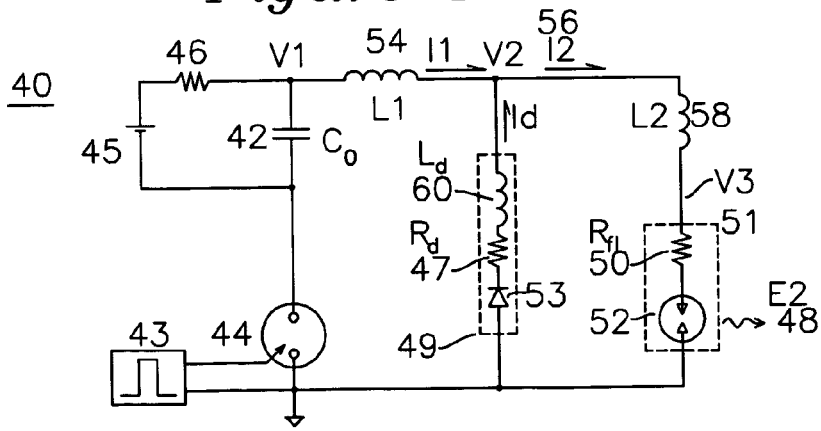
FIG. 3 shows a schematic diagram for a power source for a gas discharge tube.

FIG. 3 shows a gas discharge lamp power supply 40 comprising an energy storage capacitor 42 which is charged by a voltage source 45 and bleed resistor 46. An ignition 44 is used to instantaneously apply the capacitor 42 charge to a first, primarily parasitic inductor 54 which is coupled to a diode assembly 49 in parallel with a second, energy storage inductor 58 which is in series with a gas discharge lamp assembly 51. The diode assembly 49 includes an array of diodes 53, and also has a characteristic resistance Rd 47 and inductance Ld 60. The gas discharge lamp assembly 51 includes a series resistance $R_{fl}$ 50 and the gas discharge lamp 52 which emits an optical output E2 48. The capacitor 42 is first charged to a high potential on the order of kilovolts by voltage source 45, and trigger circuit 43 causes ignition 44 to trigger, where after it becomes conductive with a very low series resistance. For an initial duration of time, current builds in both inductors L1 and L2, in accordance with the time constant of C0 42 and series inductors L1 54 and L2 58, modified slightly by the gas discharge lamp resistance $R_{fl}$. After a quarter period of ringing as determined by the LC circuit comprising C0 42, L1 54 and L2 58, $dI_2/dt$, the derivative of the current through inductor L2 58, changes sign resulting in the voltage V2 at the diode assembly 49 reversing polarity, once the L2 times ($dI_2/dt$) voltage exceeds that of the opposite signed voltage drop, V3, across the gas discharge lamp, and diode assembly 49 begins to conduct. After this point in time, a substantial portion of the current which was carried through L2 and the flashlamp begins to flow through the diode assembly 49, thereby changing the characteristic time for discharge of the energy stored in inductor L2 to be dominated by (L2+Ld)/($R_{fl}$+Rd), until the voltage V2 becomes positive again due to the loss of energy into the parallel capacitor circuit, now parasitic, which recharges the capacitor 42 and begins its second discharge cycle, where after the current in inductor L1 changes direction, the diode assembly 49 stops conducting, and the current of L1 is once again flowing in the same direction as the current of L2. Optimization involves, among other considerations, minimizing the energy put back into the capacitor following the first quarter period and the L/R decay time of the diode 49, inductors L2 and Ld, and the gas discharge lamp 22 circuit. In addition, minimization of L1 and Ld is preferred. A condition for optimization is reached when the following equation is satisfied in the case where Ld is small compared with L2, which may be used for the selection of L2:

$$I_{mFL}\cdot\exp\left(-\left(\frac{T_0}{4}+\frac{T_1}{2}\right)\cdot\frac{(R_d+R_{fl})}{L_2}\right) > I_{mC}\cdot\frac{R_d}{\sqrt{(R_d+R_{fl})^2+\frac{L_2^2}{(L_1+L_2)\cdot C_0}}}$$

where:

L1 and L2 are the inductances of the associated inductors of FIG. 3;

C0 is the capacitance of capacitor 42 of FIG. 3;

$$T_0=2\cdot\pi\cdot((L_1+L_2)\cdot C_0)^{0.5};$$

$$T_1=2\cdot\pi\cdot[(L_1)\cdot C_0]^{0.5},$$

$I_{mFL}$ is peak current through the gas discharge lamp, $I_{mC}$ is peak current of the storage capacitor during the time period $T_0/4<t<T_0/4+T_1/2$, $R_d$ is the average resistance of a diode during the time $T_0/4<t<T_0/4+T_1/2$;

$R_{fl}$ is the average resistance of gas discharge lamp during the time $T_0/4<t<T_0/4+T_1/2$.

Additionally, $R_{fl}<<2\cdot(C_0/(L_0+L_1))^{0.5}$

Figure 4:
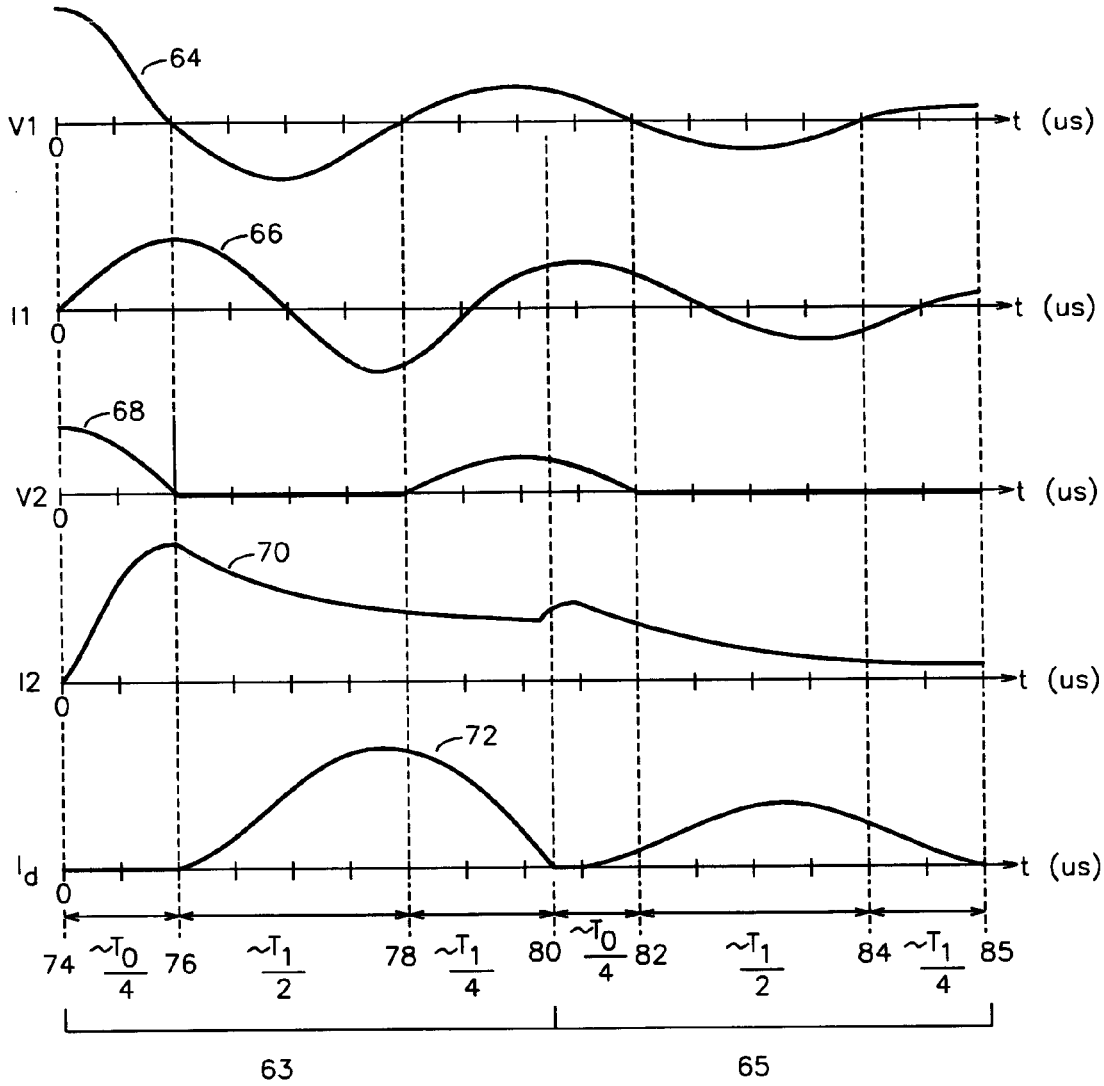
FIG. 4 shows two cycles of waveforms of operation for the circuit of FIG. 3.

FIG. 4 shows an example of waveforms for operation of the lamp power supply of FIG. 3 at various voltage and current nodes. The operation of the invention involves the interaction of two coupled circuits; the first involving the ignition switch 44, storage capacitor C0 42, and the primarily parasitic inductance L1 54; the second involving the diode assembly 49 and the inductance Ld 60 associated with the diode assembly 49 and their connection with series L2 58 and gas discharge lamp 52. These two circuits are coupled across the common elements of inductor L2 58 and gas discharge lamp 52. For the purposes of discussion, forward current flow will be adopted as that shown in the sense of I1 and I2 56 as shown in FIG. 3, through L1 54 and L2 58, respectively. Reverse current flow will be taken as opposite to the respective forward current flows. FIG. 4 shows only two cycles of operation: a first interval 63 and a second interval 65.

Time t=0 74 is the instant the ignition 44 fires, completing the RLC circuit. At this instant, diode 49 is reversed biased and not conducting, so the RLC circuit has a resonant frequency determined by L=L1+L2, C=C0, and Rfl and the capacitor voltage V1 of C0 42 is shown as waveform 64. During the first quarter cycle from firing time 74 to $T_0/4$ 76, the capacitor voltage waveform V1 64 varies sinusoidally, as does the current I1 66 which flows through inductor L1 54. When diode 49 is not conducting, waveform V2 68 varies roughly proportionally to V1 64 as shown, and current I2 70 is identical to that of I1 66.

Figure 5:
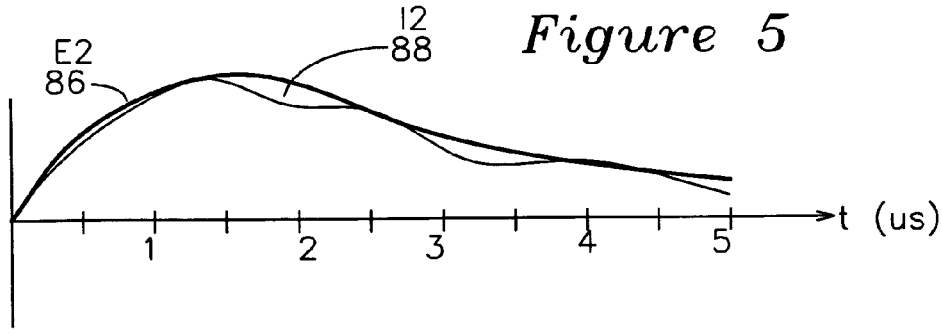
FIG. 5 shows several cycles of waveforms of operation for the circuit of FIG. 3.

Following peak current at time 76, and through to time 80 when difference between the relative polarity of the reactive voltage drop of L2, L2($dI_2/dt$), reverses and exceeds that of the then oppositely signed gas discharge lamp voltage drop, V3, and the diode 53 becomes forward biased and begins to conduct. The diode 49 causes the voltage V2 68 to clamp near 0V as shown, and a majority of the current I2 flowing through L2 58 now flows through diode 49 as Id 72. During this period of diode conduction, from 76 to 80, the finite remaining voltage V2 allows the storage capacitor to recharge in the reverse polarity. Also during this interval, the diode circuit 49 allows significantly higher Id currents associated with a faster discharge period of the energy in L2 through the diode, which contributes to maintaining the current through the gas discharge lamp in the forward direction during the subsequent capacitor charging and discharge cycle which would normally have resulted in a reversal of current flow through the gas discharge lamp due to I1. To achieve a unipolar current drive in the flashlamp, the level of forward going current circulation in the diode must always dominate over the reverse current, −I1, flowing through L2 associated with reverse polarity, relative to the initial capacitor charge polarity, of the cycles of the reverse current discharge-recharge of the storage capacitor. At the time 80, the above described cycle shown as interval 63 begins to repeat as shown in interval 65 with the capacitor recharged in the original polarity from 80 to 82 and with the subsequent change in V2 polarity due to the positive L2($dI_2/dt$) reactive voltage drop. As illustrated in FIG. 4, the gas discharge lamp current I2 70 is initially supplied solely by the capacitor through the period 74-76, waveform 66, ending shortly after the first quarter period. At time 76, the reactive voltage drop across L2, waveform 64, is reversed and exceeds the opposite polarity gas discharge lamp resistive voltage drop, V3, causing the diode to be forward biased, allowing the voltage across inductor L2 to drive current through the gas discharge lamp and the diode circuit during the period 76-80. During this interval the current I2 through the gas discharge lamp is the sum of the capacitor discharge current I1, waveform 66 and the diode circuit current Id, waveform 72. At time 80 the voltage across the diode circuit, V2, drops to zero and again changes polarity, putting the diode in reverse bias, thereby decoupling the diode circuit from the flash lamp. Following time 80 the above described cycle of operation repeats. The actual pulse formed by the power supply over a multiple such cycles of FIG. 3 is shown in FIG. 5. Waveform I2 88 shows the actual current I2 waveform produced, while the optical output power E2 is shown in waveform 86.

Figure 6:
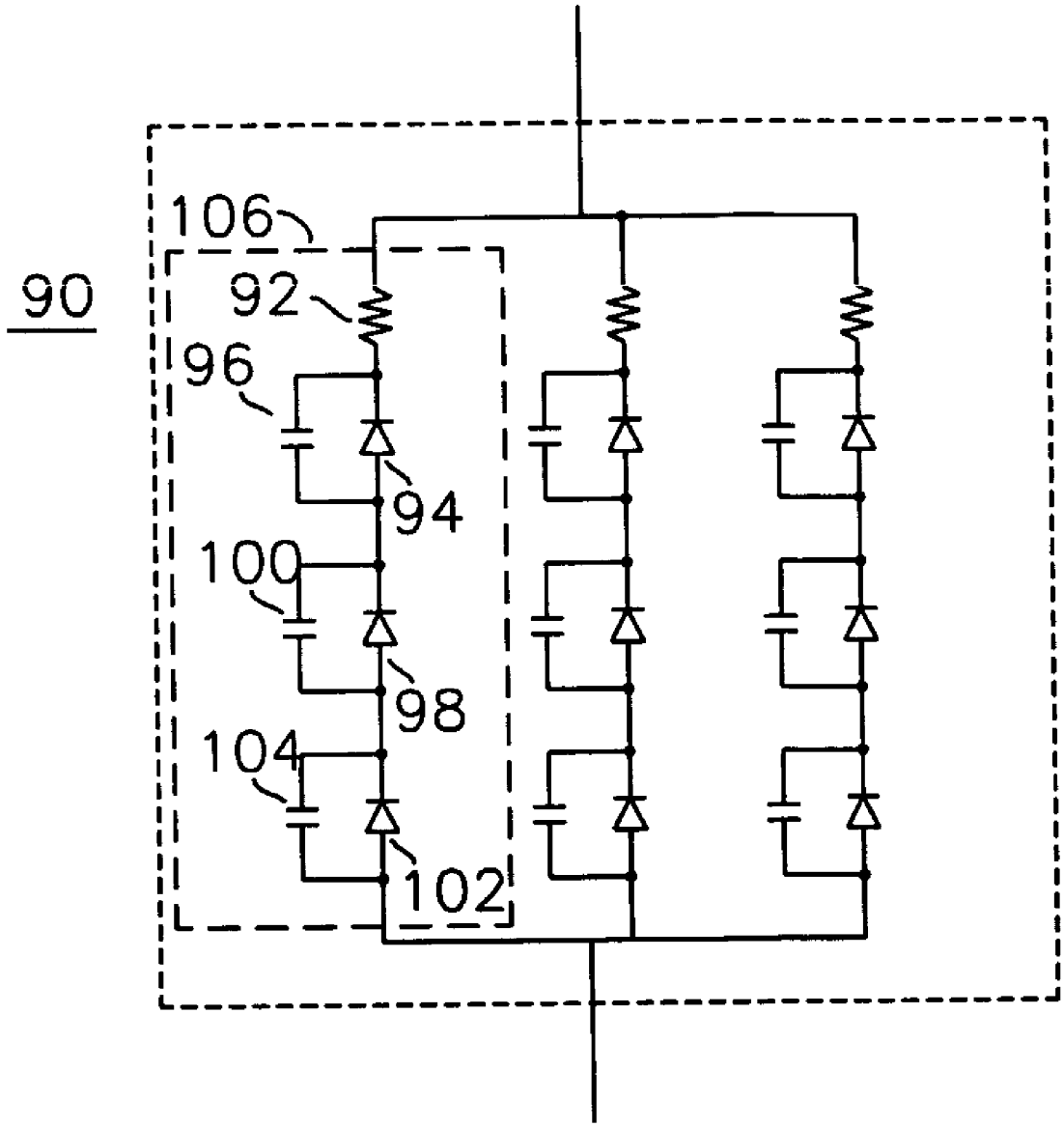
FIG. 6 shows the schematic diagram for a diode array.

The diode assembly 49 is typically not a single diode, as semiconductor diodes have reverse breakdown characteristics which cause avalanche breakdown, as known in the art of high voltage rectification. Also known as a solution to this problem in the prior art is the diode array 90 of FIG. 6, which comprises parallel strings of series diodes and voltage compensating components, one such string shown as a single string 106. The series diodes 94, 98, 102 may be any number of matched diodes, but three are shown. Resistor 92 ensures current sharing between the strings of series diodes, while capacitors 96, 100, 104 are used to divide the reverse voltage present across the diode string equally across each diode, thereby preventing a single diode from receiving all of the reverse voltage and suffering avalanche breakdown. The equal-value capacitors 96, 100, 104 could also be replaced by equal value resistors without loss of generality.

While the circuit of FIG. 3 is set forward as best mode of the invention, variations in the circuit and components are possible. Ignition 44 acts as a switch, and any switch element suitable for high voltage switching may be used as ignition 44. Also, while ignition 44 is shown as a switch element with a control trigger, it is possible to use a two terminal breakdown-mode switch which triggers simply when a threshold voltage across the terminals exceeds a particular level. The voltage source 45 and bleed resistor 46 may be replaced by any mechanism that delivers charge to capacitor 42, including a current source, or any device capable of delivering charge. Clamp diode assembly 49 may include series inductance and resistance, or any other source of loss and energy storage including but not limited to shunt and series capacitance across any nodes shown. Inductances L1 54 and L2 58 may be intentionally designed inductances, or they may be formed from component leads, or intrinsic circuit values associated with the topology of the physical elements used to realize the circuit. Flashlamp 51 may be a gas discharge lamp, or any type of optical source suitable for converting a flowing current into an optical output. It should be noted that the waveforms of FIG. 3 are approximations given to suggest the operation of the circuit over some particular time boundaries. It is clear to one skilled in the art of non-linear circuits and higher harmonic frequency current flow that the effect of currents flowing in the three mesh loops of the circuit of FIG. 3 will effect the T0 and T1 time constants, and for this reason, approximations are given for the durations of these periods, and the time references to T0 and T1 are not intended to be exact time periods. A reasonable range for T0 and T1 to vary from the values shown in the equations of the present letters patent because of inter-mesh loop coupling is from +100% to −50% of the computed value, although larger transient variations are possible during 10% of the duration T0 or T1, particularly when a current or voltage discontinuity occurs.

In this manner, an improved power supply for a gas discharge lamp is described.

We claim:

1. A power supply having:

a first series circuit comprising a capacitor charged to an initial voltage and a switch;

a first inductor coupled between said first series circuit and an output circuit;

said output circuit comprising a diode assembly in parallel with a series combination of a gas discharge lamp having a lamp resistance and a second inductor;

where said diode assembly is not substantially conducting during a first interval from said switch operation to a first time determined by a time constant of said capacitor and the series combination of said first inductor and said second inductor;

and said diode assembly is substantially conducting during a second interval following said first interval and having a time duration determined primarily by a time constant of said capacitor and said second inductor.

2. The power supply of claim 1 where said controllable switch is an ignition.

3. The power supply of claim 1 where said capacitor, said first inductor, and said second inductor are related according to:

$$I_{mFL}\cdot\exp\left(-\left(\frac{T_0}{4}+\frac{T_1}{2}\right)\cdot\frac{(R_d+R_{fl})}{L_2}\right) > I_{mC}\cdot\frac{R_d}{\sqrt{(R_d+R_{fl})^2+\frac{L_2^2}{(L_1+L_2)\cdot C_0}}}$$

where:

L1 and L2 are the inductances of said first inductor and said second inductor;

C0 is the capacitance of said capacitor;

$$T_0=2\cdot\pi\cdot((L_1+L_2)\cdot C_0)^{0.5};$$

$$T_1=2\cdot\pi\cdot[(L_1)\cdot C_0]^{0.5},$$

$I_{mFL}$ is peak current through said gas discharge lamp, $I_{mC}$ is peak current of said capacitor, $R_d$ is the resistance of said diode;

$R_{fl}$ is the resistance of said gas discharge lamp.

4. The power supply of claim 3 where said peak capacitor current is determined during the time period t where $$0<t<T_0/4.$$

5. The power supply of claim 3 where said diode resistance is the average resistance during the time period t where $T_0/4<t<T_0/4+3T_1/4$.

6. The power supply of claim 3 where said gas discharge lamp resistance is the average resistance during the time t where $0<t<T_0/4+3T_1/4$.

7. The power supply of claim 3 where $$R_{fl}<<2\cdot(C_0/(L_0+L_1))^{0.5}.$$

8. The gas discharge lamp of claim 1 where said diode comprises a plurality of individual series diodes.

9. The gas discharge lamp of claim 8 where each said individual series diode has substantially the same reverse voltage applied at a particular instant in time.

10. The gas discharge lamp of claim 8 where each said individual series diode includes a plurality of parallel individual diodes.

11. The gas discharge lamp of claim 10 where each said parallel individual diode carries substantially the same current at a particular instant in time.

12. A power supply having:

a reference node;

a source of charge comprising a capacitor in series with a switch, said source of charge having one end connected to said reference node and the other end being a charge output;

a clamping diode connected between said reference node and said charge output;

a load comprising a gas discharge lamp connected in series with a storage inductor, said load connected between said reference node and said charge output.

13. The power supply of claim 12 where said switch comprises an ignition.

14. The power supply of claim 12 where said clamping diode includes a series inductance and a series resistance.

15. The power supply of claim 12 where said capacitor, said first inductor, and said second inductor are related according to:

$$I_{mFL}\cdot\exp\left(-\left(\frac{T_0}{4}+\frac{T_1}{2}\right)\cdot\frac{(R_d+R_{fl})}{L_2}\right)>I_{mC}\cdot\frac{R_d}{\sqrt{(R_d+R_{fl})^2+\frac{L_2^2}{(L_1+L_2)\cdot C_0}}}$$

L1 and L2 are the inductances of said first inductor and said second inductor;

C0 is the capacitance of said capacitor;

$$T_0=2\cdot\pi\cdot((L_1+L_2)\cdot C_0)^{0.5};$$

$$T_1=2\cdot\pi\cdot[(L_1)\cdot C_0]^{0.5},$$

$I_{mFL}$ is peak current through said gas discharge lamp, $I_{mC}$ is peak current of said capacitor, $R_d$ is the resistance of said diode;

$R_{fl}$ is the resistance of said gas discharge lamp.

16. The power supply of claim 12 where $$R_{fl}<<2\cdot(C_0/(L_0+L_1))^{0.5}.$$

17. The power supply of claim 15 where said peak capacitor current is determined during the time period t where $$0<t<T_0/4.$$

18. The power supply of claim 15 where said diode resistance is the average resistance during the time period t where $T_0/4<t<T_0/4+3T_1/4$.

19. The power supply of claim 15 where said gas discharge lamp resistance is the average resistance during the time t where $0<t<T_0/4+3T_1/4$.

20. The power supply of claim 15 where $$R_{fl}<<2\cdot(C_0/(L_0+L_1))^{0.5}.$$

21. The gas discharge lamp of claim 12 where said diode comprises a plurality of individual series diodes.

22. The gas discharge lamp of claim 21 where each said individual series diode has substantially the same reverse voltage applied at a particular instant in time.

23. The gas discharge lamp of claim 21 where each said individual series diode includes a plurality of parallel individual diodes.

24. The gas discharge lamp of claim 23 where each said parallel individual diode carries substantially the same current at a particular instant in time.

* * * * *

UNITED STATES PATENT AND TRADEMARK OFFICE

CERTIFICATE OF CORRECTION

PATENT NO. : 7,221,100 B2
APPLICATION NO. : 11/203599
DATED : May 22, 2007
INVENTOR(S) : Baksht et al.

It is certified that error appears in the above-identified patent and that said Letters Patent is hereby corrected as shown below:

On the title page item (57), in the 2nd line of the Abstract, change "ignition" to --ignitron--

Column 1, lines 16, 27, and 31 "ignition" should be changed to --ignitron--

Column 3, lines 37 and 48 "ignition" should be changed to --ignitron--

Column 3, line 65 "(L2+Ld)/($R_{ff}$+Rd)" should be changed to --(L2+$L_d$)/($R_{ff}$+$R_d$)--

Column 4, lines 44 and 57 "ignition" should be changed to --ignitron--

Column 4, line 60 "and Rfl and the" should be changed to --and $R_{ff}$ and the--

Column 6, lines 1, 3 (twice), and 56 "ignition" should be changed to --ignitron--

Column 7, line 48 "ignition" should be changed to --ignitron--

Signed and Sealed this

Eighth Day of September, 2009

David J. Kappos

David J. Kappos
*Director of the United States Patent and Trademark Office*